US010135151B2

(12) United States Patent
Grangerat

(10) Patent No.: US 10,135,151 B2
(45) Date of Patent: Nov. 20, 2018

(54) SEGMENTED STRUCTURE, ESPECIALLY FOR A SATELLITE ANTENNA REFLECTOR

(71) Applicant: AIRBUS DEFENCE AND SPACE SAS, Les Mureaux (FR)

(72) Inventor: Francis Grangerat, Conflans Sainte Honorine (FR)

(73) Assignee: ArianeGroup SAS, Paris (FR)

( * ) Notice: Subject to any disclaimer, the term of this patent is extended or adjusted under 35 U.S.C. 154(b) by 256 days.

(21) Appl. No.: 15/022,065

(22) PCT Filed: Sep. 11, 2014

(86) PCT No.: PCT/FR2014/000206
§ 371 (c)(1),
(2) Date: Mar. 15, 2016

(87) PCT Pub. No.: WO2015/044535
PCT Pub. Date: Apr. 2, 2015

(65) Prior Publication Data

US 2016/0226135 A1 Aug. 4, 2016

(30) Foreign Application Priority Data

Sep. 26, 2013 (FR) ..... 13 02234

(51) Int. Cl.
*H01Q 15/16* (2006.01)
*H01Q 1/28* (2006.01)

(52) U.S. Cl.
CPC ..... *H01Q 15/162* (2013.01); *H01Q 1/288* (2013.01); *H01Q 15/161* (2013.01)

(58) Field of Classification Search
CPC ..... H01Q 15/162; H01Q 15/161
See application file for complete search history.

(56) References Cited

U.S. PATENT DOCUMENTS 6,191,757 B1 * 2/2001 Bassily ..... H01Q 1/288 343/912
2003/0024772 A1 2/2003 Naitoh

FOREIGN PATENT DOCUMENTS

EP 1 043 802 A2 10/2000
JP 59-126305 A 7/1984
(Continued)

OTHER PUBLICATIONS

International Search Report dated Dec. 4, 2014, issued in corresponding International Application No. PCT/FR2014/000206, filed Sep. 11, 2014, 8 pages.
(Continued)

*Primary Examiner* — Jessica Han
*Assistant Examiner* — Amal Patel
(74) *Attorney, Agent, or Firm* — Christensen O'Connor Johnson Kindness PLLC

(57) ABSTRACT

A segmented structure includes at least two panels, a first panel, called the main panel, a second panel, called the secondary panel. The structure further includes at least one deployment device configured to move secondary panel into a storage position or a deployed position. The deployment device has a translation system having an assembly with articulated arms, wherein the translation system is able to generate a movement of the secondary panel in translation in relation to the main panel. The translation system is connected to the secondary panel by an outer end. A rotation system is able to generate a rotation of the translation system and of the secondary panel connected to the translation system, in relation to the main panel.

14 Claims, 5 Drawing Sheets

(56) References Cited

FOREIGN PATENT DOCUMENTS

| | | | | | |
|---|---|---|---|---|---|
| JP | 59126305 | A | * | 7/1984 | ..... H01Q 15/162 |
| JP | 60-27203 | A | | 2/1985 | |
| JP | 60027203 | A | * | 2/1985 | ..... H01Q 15/162 |
| JP | 2000-044267 | A | | 2/2000 | |

OTHER PUBLICATIONS

Written Opinion dated Dec. 4, 2014, issued in corresponding International Application No. PCT/FR2014/000206, filed Sep. 11, 2014, 8 pages.
Written Opinion of the International Searching Authority dated Dec. 4, 2014, issued in corresponding International Application No. PCT/FR2014/000206, filed Sep. 11, 2014, 12 pages.
International Preliminary Report on Patentability dated Mar. 29, 2016, issued in corresponding International Application No. PCT/FR2014/000206, filed Sep. 11, 2014, 1 page.

* cited by examiner

SEGMENTED STRUCTURE, ESPECIALLY FOR A SATELLITE ANTENNA REFLECTOR

The present invention relates to a segmented structure.

This segmented structure comprises at least two interconnected panels that are intended for being extended in space.

Although not exclusively, the present invention applies more particularly to a segmented structure that is part of a satellite antenna reflector used in telecommunications, in particular to a large antenna reflector that operates in high frequency bands. Such an antenna reflector generally comprises a rigid structure (known as a shell) that is provided with a reflective surface and reinforcement means at the rear of this surface which play a role in retaining the shell and contribute to the connection to the satellite.

The large dimensions of the shell of such a reflector pose problems relating to bulk when a satellite provided with such a reflector is sent into space by means of a space shuttle.

Furthermore, a segmented structure provided with a plurality of panels, in particular a structure having three panels, comprising a central panel and two end panels, is provided for rigid reflectors having diameters of several meters.

This segmented structure further comprises a device that is intended for permitting an extension by means of the end panel and is suitable for bringing the end panel into either of the following positions relative to the main panel:

- a storage position, in which the end panel is positioned above the main panel on the rear face thereof, the front face of the end panel being oriented in the same direction as the front face of the main panel;
- an extended position, in which the end panel is positioned next to and against the main panel in such a way as to form a continuous assembly at least on the front faces of the panels.

In a segmented structure of this type, each end panel can thus assume a storage position for being transported in the space shuttle and an extended position once the satellite is in space.

The present invention relates to a segmented structure, in particular for a satellite antenna reflector, comprising at least two panels and an extension device which allows for these two panels to be extended in space in both a beneficial and effective manner.

According to the invention, said segmented structure of the type comprising:

- at least two panels, namely a first panel, referred to as the main panel, having a front face and a rear face, and a second panel, referred to as the secondary panel, which likewise has a front face and a rear face; and
- at least one extension device that is connected to the rear faces of said main and secondary panels respectively, and is capable of bringing said secondary panel into one or the other of the two following positions relative to the main panel:
  - a storage position, in which said secondary panel is positioned at least in part above said main panel on the rear face thereof, the front face of said secondary panel being oriented in the same direction as the front face of said main panel; and
  - an extended position, in which said secondary panel is positioned next to and against said main panel in such a way as to form a continuous assembly at least on the front faces of the panels;

is distinctive in that said extension device comprises:

- a translation system comprising an assembly of articulated arms, said translation system being capable of causing said secondary panel to translate relative to said main panel and being connected to said secondary panel by an end, referred to as the external end; and
- a rotation system that is capable of causing said translation system and the secondary panel connected to said translation system to rotate relative to said main panel, said rotation system being connected to both an end, referred to as the internal end, of said translation system, and to the rear face of said main panel.

Therefore, by virtue of the invention, the secondary panel of the segmented structure can be extended in space from the storage position into the extended position in a beneficial and effective manner, as set out below.

Said rotation system that is capable of causing said translation system to rotate comprises:

- in a first embodiment, two coaxial motors that are synchronised and controlled in such a way as to bring about rotations in the same direction; and
- in a second embodiment, a transmission spindle that interconnects the internal ends of the two arms of the translation system, and a motor for rotating said transmission spindle.

Moreover, in a preferred embodiment, said translation system comprises:

- an assembly of two identical articulated arms, each of said articulated arms comprising an external segment and an internal segment that are interconnected by means of a pivot connection, the external segment of each of said arms being connected by means of a pivot connection to the rear face of said secondary panel; and
- an auxiliary rotation system that is connected to an internal end of each of the internal segments of the two articulated arms and is capable of causing a rotation in the region of each of said internal ends in a synchronised manner and in opposite directions in such a way as to open out or fold away said assembly of articulated arms.

For each of said articulated arms, the external connection of the external segment to the rear face of the secondary panel is equipped with a flexible joint in order to ensure a degree of freedom.

Moreover, in a first embodiment, said auxiliary rotation system comprises two motors, one of which is connected to the internal end of the internal segment of a first of said arms and is capable of causing said internal segment to rotate, and the other of which is connected to the internal end of the internal segment of the second of said arms and is capable of causing said internal segment to rotate, these two motors being synchronised and controlled in such a way as to bring about rotations in opposite directions.

Furthermore, in a second embodiment, said auxiliary rotation system comprises a single motor that is connected to both:

- the internal end of the internal segment of a first of said arms by means of a first connection for transmitting rotations, preferably a belt, which is capable of causing said internal segment to rotate, and
- the internal end of the internal segment of the second of said arms by means of a second connection for transmitting rotations, preferably a belt, which is capable of causing said internal segment to rotate;

said first and second connections for transmitting rotations being driven by said single motor in such a way as to transmit rotations in opposite directions at the same speed.

Said single motor is preferably a gear reducer having two outlets that are opposite each other, each outlet being provided with a pulley which makes it possible to transmit a rotation.

Moreover, in a preferred embodiment, the segmented structure comprises:

a central main panel;

two secondary panels arranged on either side of said central main panel when in the extended position in such a way as to be parabolic; and two extension devices connected to each of the secondary panels respectively.

The present invention also relates to:

a satellite antenna reflector comprising a segmented structure as set out above; and a satellite comprising at least one such segmented structure or such an antenna reflector.

The present invention also relates to a method for extending a segmented structure as set out above.

According to the invention, this method comprises, during the extension from the storage position into the extended position, the successive steps of:

a) performing a rotation from the storage position in a first rotation direction by means of said rotation system in such a way as to move said translation system provided at the external end of the secondary panel away from the rear face of the main panel;

b) performing a translational movement in a first translation direction by means of said translation system in such a way as to bring said system into an opened out position;

c) performing a rotation in the direction counter to the first rotation direction by means of said rotation system in such a way as to bring the secondary panels and the main panel substantially into a common general plane; and d) performing a translational movement in the direction counter to the first translation direction by means of said translation system in such a way as to bring the secondary panel into contact with the main panel into a position that is the extended position.

At step d), the auxiliary rotation system of the translation system performs:

a rotation in the same direction as in step b), in a first embodiment, in which the opened out position of the translation system corresponds to the maximum extension position of said translation system; and a rotation in the direction counter to that in step b), in a second embodiment.

The figures in the accompanying drawings will give a better understanding of how the invention can be implemented. In these figures, identical references denote similar elements.

Figure 1:
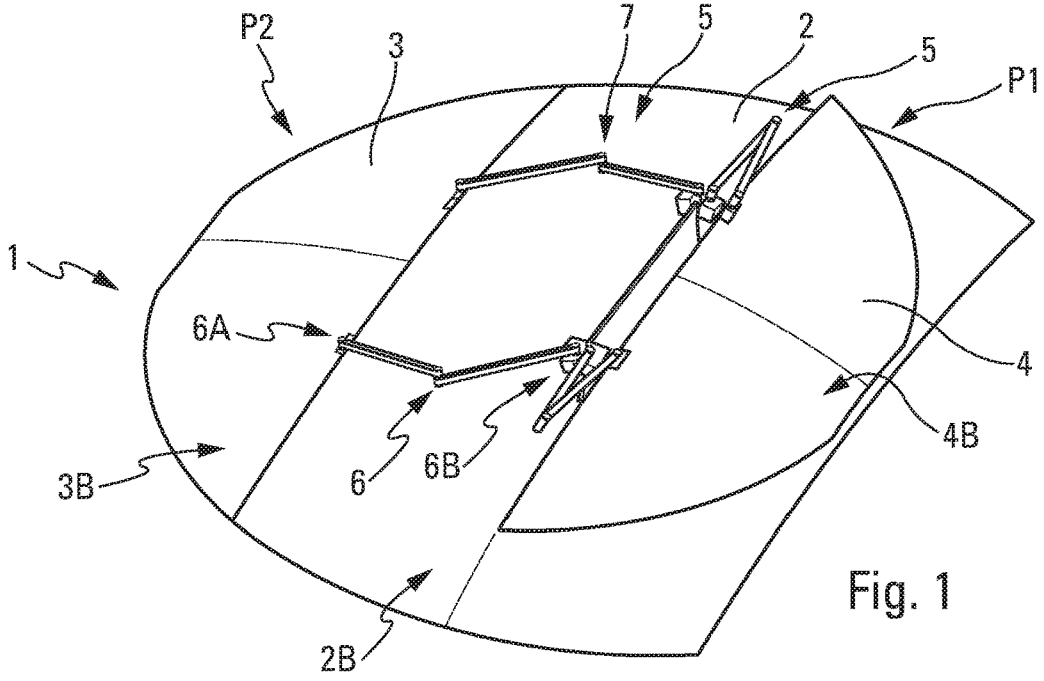
FIG. 1 is a schematic view in perspective of a particular embodiment of a segmented structure that illustrates the invention and comprises a central panel and two secondary panels, one of which is in a storage position and the other of which is in an extended position.

The segmented structure 1 that illustrates the invention and is schematically shown in particular in FIG. 1 is intended, in particular but not exclusively, for a satellite antenna reflector used in telecommunications. When extended in space, such an antenna reflector generally comprises a rigid structure (known as a shell) that is provided with a reflective surface and reinforcement and retaining means (not shown) at the rear of this structure which play a role in retaining the shell and contribute to the connection to the satellite. Particularly for reasons of bulk when launching the satellite into space using a space shuttle, this structure is segmented, i.e. formed of a plurality of segments or panels.

More specifically, the present invention relates to a segmented structure 1 of the type comprising:

at least two panels, namely at least one first panel 2, referred to as the main panel, having a front face 2A and a rear face 2B (FIGS. 10 and 11), and at least one second panel 3, 4, referred to as the secondary panels, which likewise have a front face 3A, 4A and a rear face, 3B, 4B; and at least one extension device 5 that is connected to the rear faces 2B and 3B of the main panel 2 and of a secondary panel (panel 3 in the example from FIG. 2), respectively.

Figure 4:
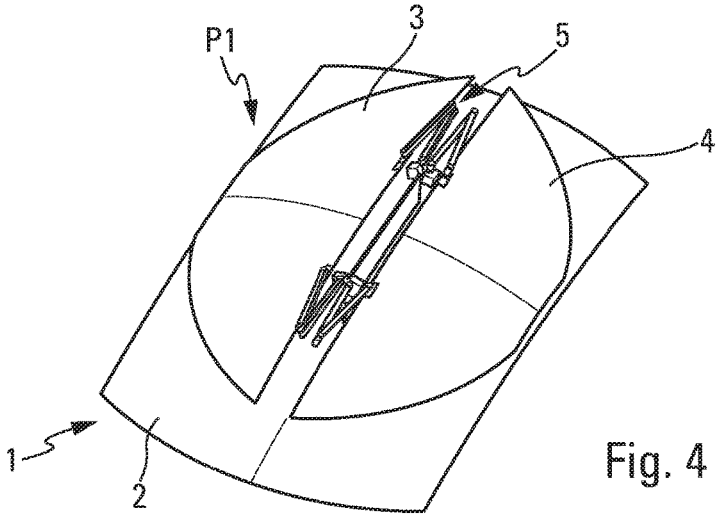
FIGS. 4 to 8 are schematic views in perspective of different successive steps of extending a secondary panel relative to a main panel of a segmented structure.
Figure 8:
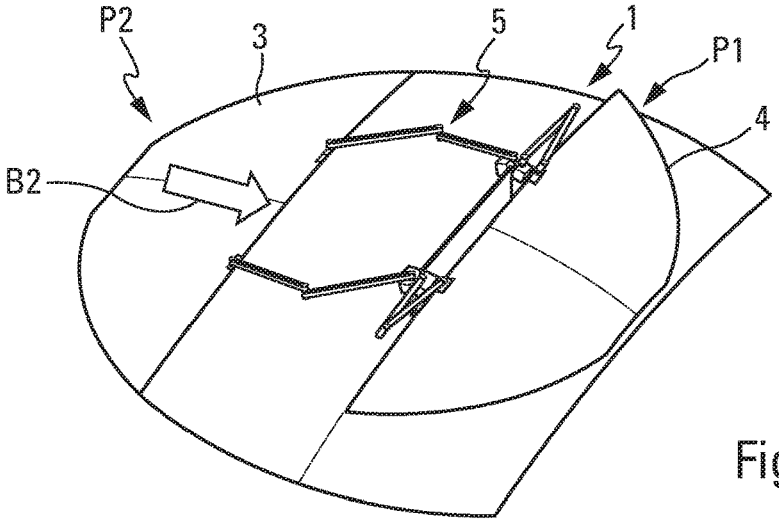
Figure 9:
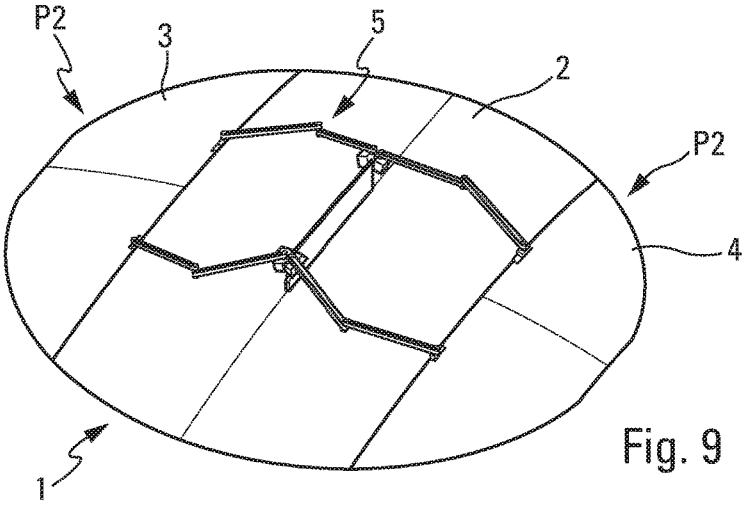
FIG. 9 is a schematic view in perspective of a completely extended segmented structure.
Figure 10:
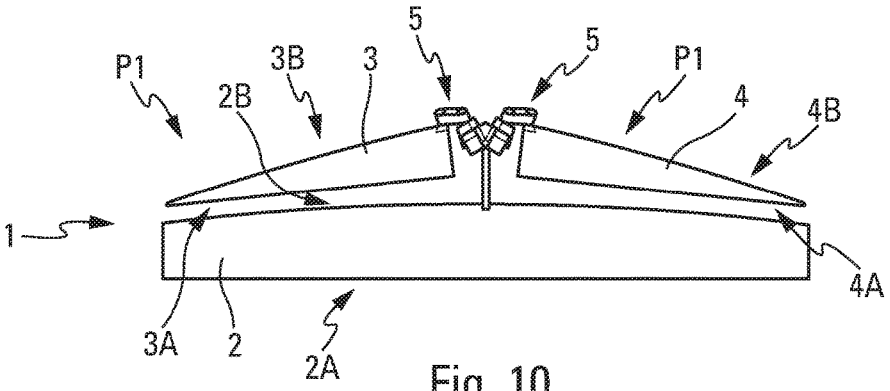
FIG. 10 is a cross sectional view of a segmented structure in a fully stored position.
Figure 11:
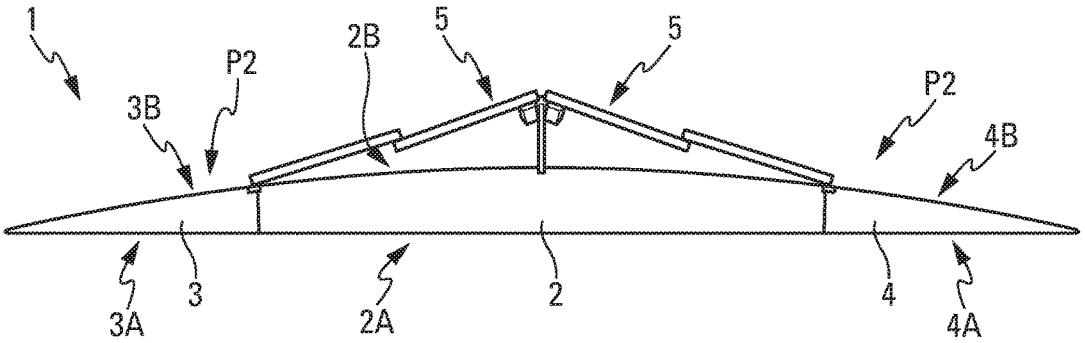
FIG. 11 is a cross sectional view of a segmented structure in a completely extended position.
Figure 12:
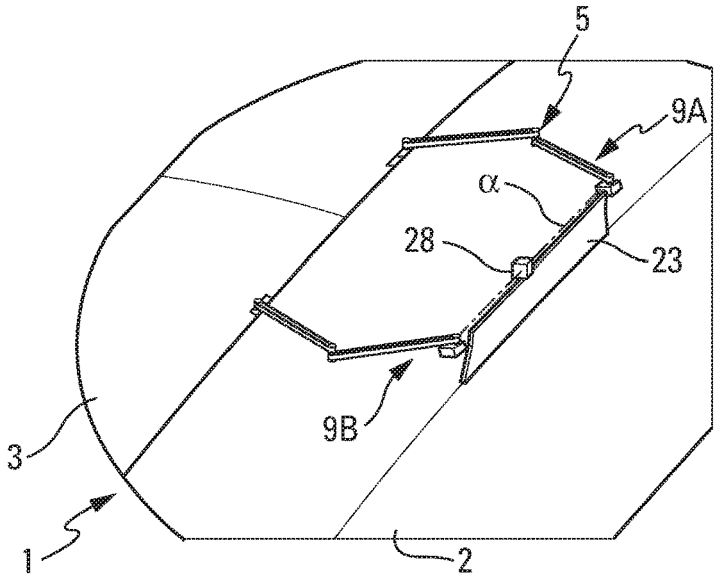
FIGS. 12 and 13 are schematic views in perspective of particular embodiments of the rotation system.

This extension device 5 is capable of bringing the secondary panel 3 into one or the other of the two following positions relative to the main panel 2:

a storage position P1 as shown in FIGS. 4 and 10, in which said secondary panel 3 is positioned at least in part, preferably completely, above said main panel 2 on the rear face 2B thereof. The front face 3A of the secondary panel 3 is oriented in the same direction as the front face 2A of the main panel 2; and an extended position P2 as shown in FIGS. 8, 9 and 11, in which the secondary panel 3 is positioned next to and against the main panel 2 in such a way as to form a continuous assembly at least on the front faces 2A, 3A of the panels.

In the description of the present invention:

front face and rear face are understood to mean the two faces of a panel, the front face 3A, 4A of a secondary panel 3, 4 being positioned at least in part above the rear face 2B of the main panel 2, each front face 2A, 3A, 4A corresponding, in the case of an antenna reflector, to the reflective face thereof; and internal and external are understood to mean the positions of the different elements in question relative to the centre of the segmented structure 1 in the extended position thereof, "internal" applying to the position closest to the centre and "external" applying to the position furthest away from the centre in this extended position.

In the preferred embodiment shown in the figures, the segmented structure 1 comprises:

a central main panel 2;

two secondary panels 3 and 4 arranged on either side of said central main panel 2 when in the completely extended position (FIGS. 9 and 11) such that these three panels 2, 3 and 4 are parabolic in this completely extended position; and two extension devices 5 connected to each of said secondary panels 3 and 4, respectively.

In the situation shown in FIG. 1, one 3 of the secondary panels 3 and 4 is in the extended position P2 and the other 4 of said secondary panels 3 and 4 is in the storage position P1.

Figure 2:
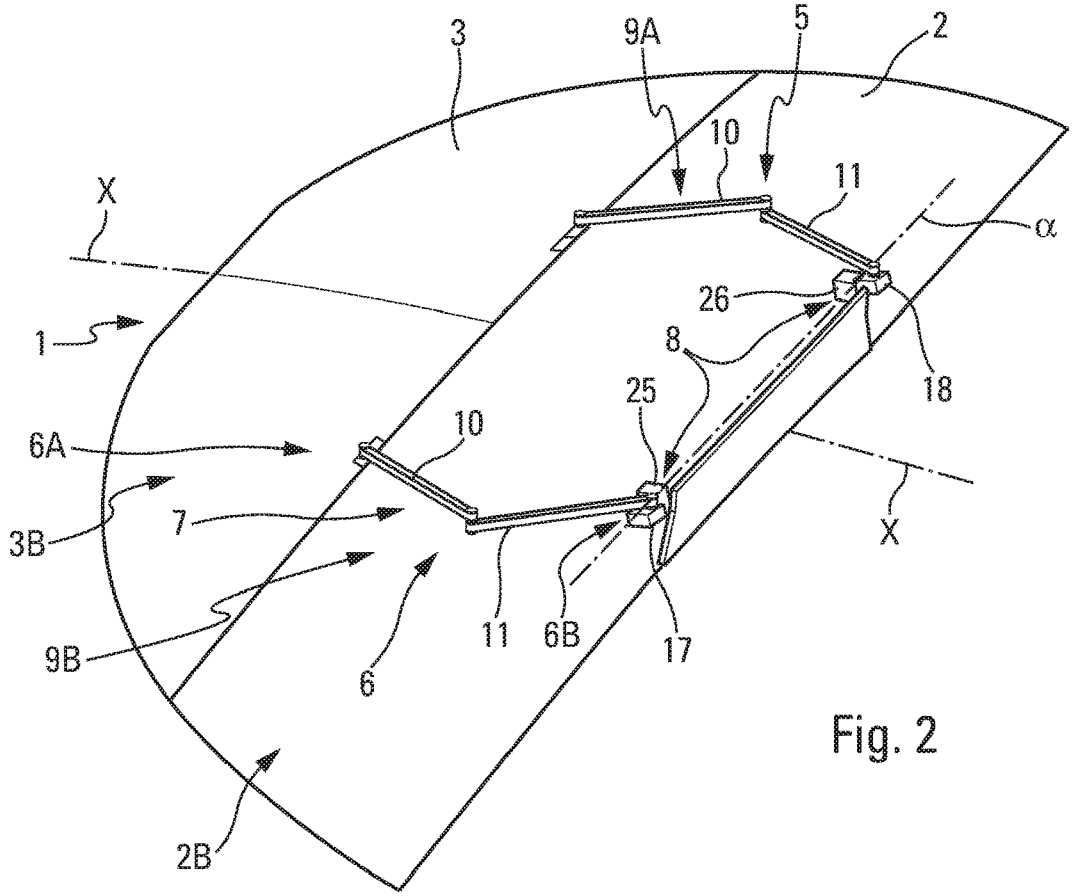
FIG. 2 shows an embodiment of an extension device.

According to the invention, each of the extension devices 5 of the segmented structure 1 comprise:

- a translation system 6 comprising an assembly 7 of articulated arms. The translation system 6 is capable of causing the secondary panel 3, 4 to translate relative to the main panel 2 and is connected to the secondary panel 3, 4 by an external end 6A; and
- a rotation system 8 that is capable of causing said translation system 6 and the secondary panel 3, 4 connected to said translation system 6 to rotate relative to said main panel 2 about an axis a (FIG. 2). Said rotation system 8 is connected to both an internal end 6B of the translation system 6 and to the rear face 2B of the main panel 2.

In the embodiment shown in the figures, the connection to the rear face 2B of the main panel 2 is produced by means of a preferably planar structural element 23 which is fixed to the rear face 2B and the function of which is to support the extension devices 5 of the two secondary panels 3 and 4.

Such an extension device 5 enables the secondary panel to which it is connected to extend from the storage position P1 into the extended position P2 in a beneficial and effective manner, as set out below.

Figure 3:
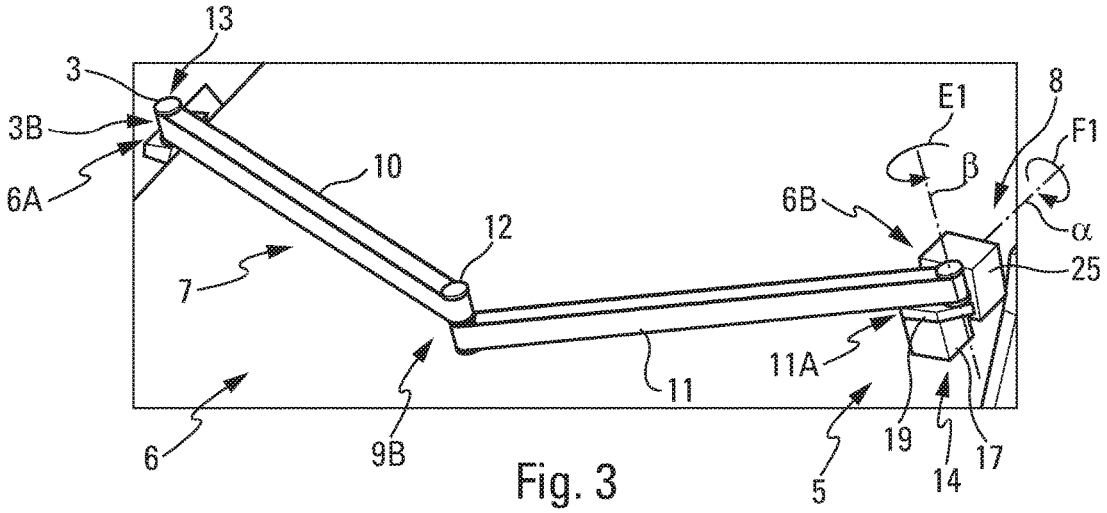
FIG. 3 is a schematic view of an assembly of articulated arms from FIG. 2.

The translation system 6 comprises an assembly 7 of two identical articulated arms 9A and 9B that are arranged symmetrically relative to an axis X-X of the segmented structure 1, in particular an axis of symmetry, as shown in FIG. 2. Each of said articulated arms 9A and 9B comprises an external segment 10 and an internal segment 11 that are interconnected by means of a pivot connection 12 as shown in FIG. 3. Furthermore, the external segment 10 of each of said arms 9A and 9B is connected to the rear face 3B of the secondary panel 3 by means of a pivot connection 13.

In the preferred embodiment shown in the figures, said translation system 6 further comprises an auxiliary rotation system 14, 15.

This auxiliary rotation system 14, 15 is connected to an internal end 11A of each of the internal segments 11 of the articulated arms 9A and 9B, and directly engages the internal ends 11A in such a way as to cause a rotation about an axis 11 in the region of each of the two internal ends 11A. The auxiliary rotation system 14, 15 causes rotations in the region of the two internal ends 11A of the two arms 5A and 5B in a synchronised manner and in opposite directions in such a way as to open out or fold away said assembly 7 of articulated arms so that the assembly 7 is moved rectilinearly along the axis X-X.

Indeed, the rotation (illustrated by an arrow E1 about the axis ß in FIG. 3) is brought about by the auxiliary rotation system 14. Given that the rotations brought about on the two articulated arms 9A and 9B of the assembly 7, respectively, occur in opposite directions (in the direction of the arrow E1 for 9B and in the opposite direction of the arrow E2 for 9A as shown for example in FIG. 13), and in a synchronised manner, that is to say at the same speed, the rotations cause the assembly 7 of arms (and therefore the extension system 5) to translate as shown for example by an arrow B1 in FIG. 6.

In a first embodiment shown in FIGS. 1 to 3, said auxiliary rotation system 14 comprises two motors 17 and 18 (for example stepping motors). One 17 of said motors 17 and 18 is connected to the internal end 11A of the internal segment 11 of a first arm 9B and is capable of causing this internal segment 11 to rotate. The other 18 of said motors 17 and 18 is connected to the internal end 11A of the internal segment 11 of the second arm 9A and is likewise capable of causing this internal segment 11 to rotate. Said motors 17 and 18, for example gear reducer servomotors, are synchronised and controlled in such a way as to bring about rotations in opposite directions E1 and E2 about the parallel axes β by means of a conventional transmission means 19 in each case.

Figure 13:
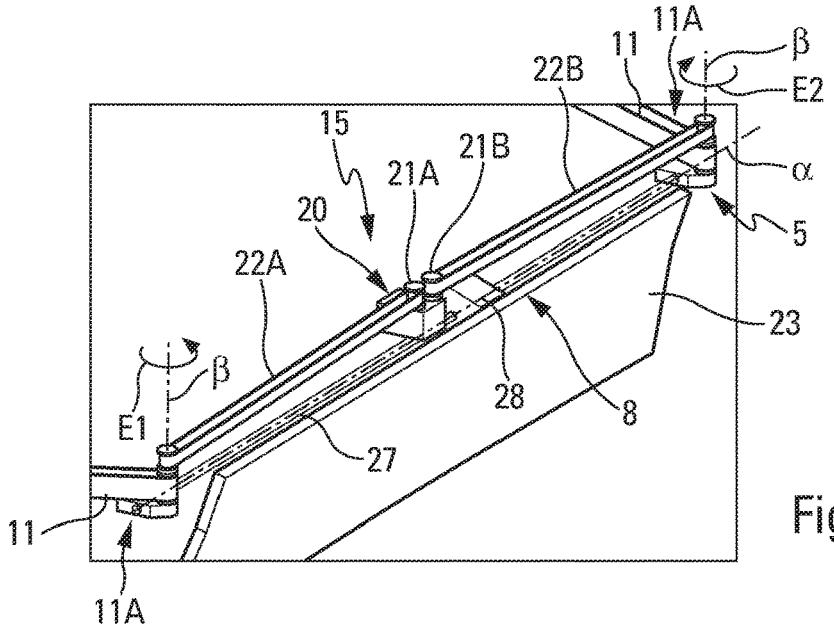

Furthermore, in a second embodiment shown in FIG. 13, said auxiliary rotation system 15 comprises a single motor 20 arranged centrally between the internal ends of the arms 9A and 9B. Said central motor 20 preferably comprises a gear motor reducer having two outlets that are opposite each other. Each outlet is provided with a pulley 21A, 21B which makes it possible to transmit rotations to segments 11 of the arms 9A and 9B by means of connections 22A, 22B for transmitting rotations, preferably by means of belts. This single central motor 20 is thus connected to both:

- the internal end 11A of the internal segment 11 of a first arm 9B by means of a first connection 22A for transmitting rotations which is capable of causing said segment to rotate, and
- the internal end 11A of the internal segment 11 of the second arm 9A by means of a second connection 22B for transmitting rotations which is capable of causing said segment to rotate.

Said first and second connections 22A and 22B are driven by the motor 20 in such a way as to transmit rotations in opposite directions at the same speed.

Moreover, the rotation system 8 (capable of causing the translation system 6 to rotate about the main axis of rotation a) may also be provided in different ways. Said system is preferably connected to the rear face 2A of the main panel 2 by means of the substantially planar support element 23.

In a first embodiment shown in FIGS. 2 and 3, said rotation system 8 comprises two coaxial motors 25 and 26 (along the axis a) that directly engage the axis of rotation of each arm 9A and 9B. These motors 25 and 26 are synchronised and bring about rotations in the same direction, as shown by an arrow F1 in FIG. 3.

Moreover, in a second embodiment shown in FIG. 13, said rotation system 8 comprises a transmission spindle 27 that is connected to the ends of the arms 9A and 9B in such a way as to mechanically interconnect these two arms 9A and 9B. This transmission spindle 27 is driven by a suitable motor 28, for example a screw jack, which is fixed to the support element 23. The translational movement of the jack causes the transmission spindle 27 to rotate.

Figure 14:
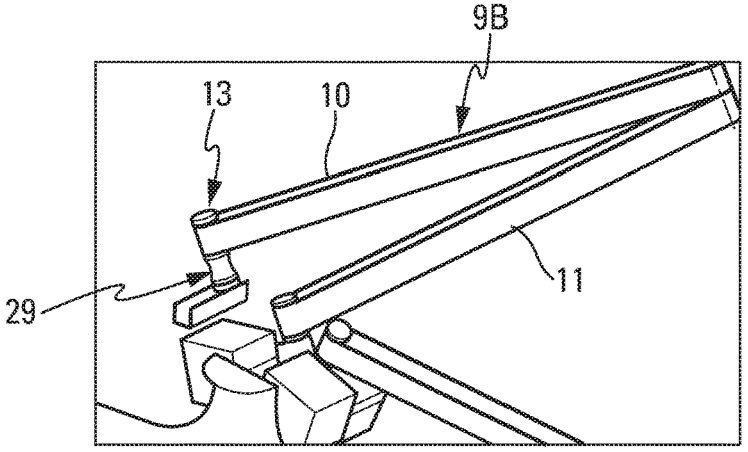
FIG. 14 shows a particular embodiment of a connection between an arm and a secondary panel.

Moreover, in a particular embodiment shown in FIG. 14, for each of the articulated arms 9A and 9B, the external connection of the external arm 10 to the rear face 3B of the secondary panel 3 is flexible, for example by means of a suitable joint 29, in such a way as to create a certain flexibility between the secondary panel 2 and the arm assembly 7, in particular in order to facilitate a final positioning as shown in FIG. 8 and set out below.

The extension devices 5 of the segmented structure 1 that are connected to different secondary panels 3 and 4 of this segmented structure 1 thus allow for the segmented structure 1 to be extended from the fully stored position (in which all the secondary panels 3 and 4 are in a storage position P1 as shown in particular in FIG. 10) into a completely extended position (in which all the secondary panels 3 and 4 are in an extended position P2 as shown in particular in FIG. 11).

The extension device 5 also comprises means that are not shown (for example a central unit) for controlling the rotation systems 8, 14, 15.

Moreover, the segmented structure 1 may comprises conventional means (not shown) for retaining different panels 2, 3 and 4 in the storage position P1. These retaining means are released before extension takes place so that each extension device 5 can carry out the extension as set out below.

Figure 5:
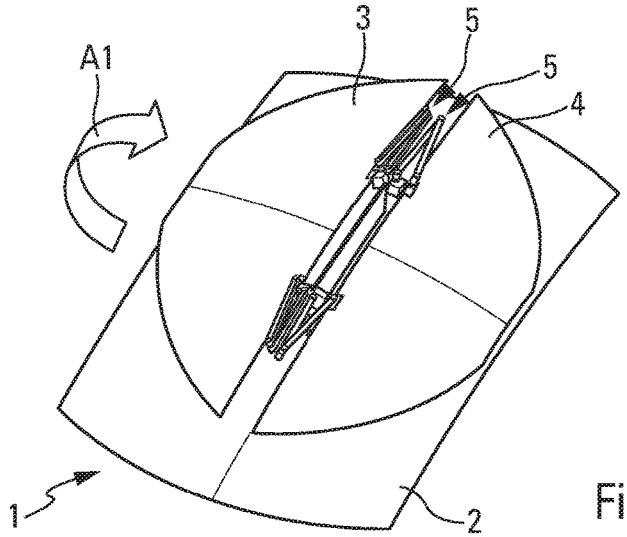
Figure 6:
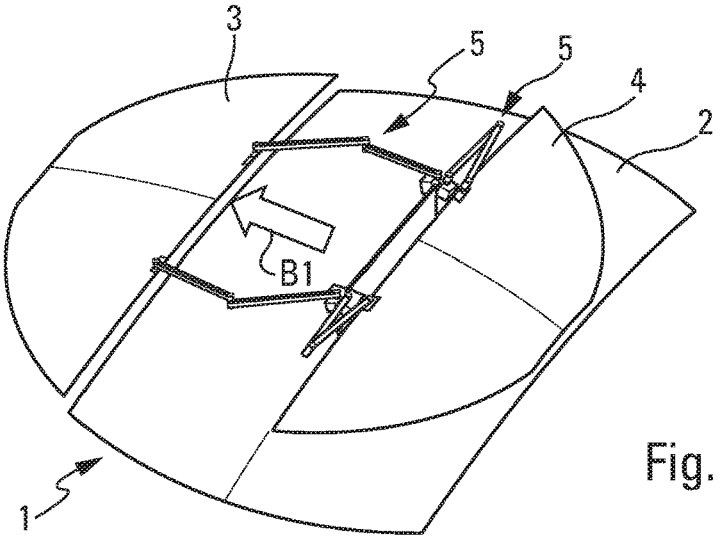
Figure 7:
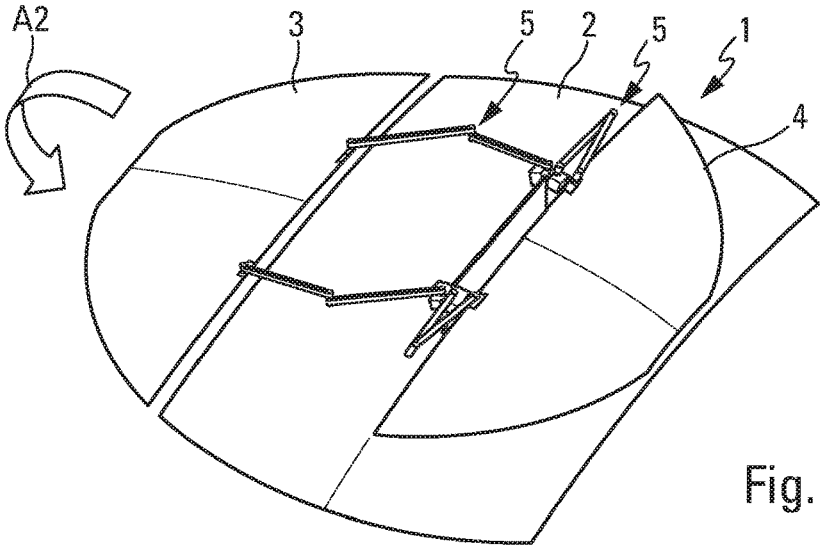

The operation of said extension device 5 for extending one 3 of said secondary panels 3, 4 from the storage position P1 in FIG. 4 into the extended position P2 in FIG. 8 is carried out as follows:

a) performing a rotation from the storage position P1 in FIG. 4 in a first rotation direction A1 (shown in FIG. 5) by means of said rotation system 8 in such a way as to move the translation system 6, provided at the external end 6A thereof with the secondary panel 3, away from the rear face 2A of the main panel 2, as shown in FIG. 5;

b) performing a translational movement in a first translation direction B1 (shown in FIG. 6) by means of said translation system 6 in such a way as to bring said system into an opened out position, as shown in FIG. 6;

c) performing a rotation in a direction A2 (shown in FIG. 7) counter to said first rotation direction A1 by means of said rotation system 8 in such a way as to bring the secondary panel 3 and the main panel 2 substantially into a common general plane, as shown in FIG. 7; and d) performing a translational movement in a direction B2 (shown in FIG. 8) counter to said first translation direction B1 by means of said translation system 6 in such a way as to bring the secondary panel 3 into contact with the main panel 2 in a position that is the extended position P2, as shown in FIG. 8.

The same extension method is carried out for the secondary panel 4 so as to ultimately achieve the completely extended position of the segmented structure 1 from FIG. 9.

At step d), the auxiliary rotation system 14, 15 of the translation system 6 may perform:

a rotation (about ß) in the same direction as in step b), in a first embodiment, in which the opened out position of the translation system 6 corresponds to the maximum extension position thereof; and a rotation (about ß) in the direction counter to that in step b), in second embodiment.

In these two cases, the rotation results in a translational movement in the direction shown by arrow B2 in FIG. 8 which makes it possible to bring the secondary panel 3 into contact with the main panel 2.

Of course, if it proved necessary, for example for the purpose of a validation operation, the device 5 may likewise bring the segmented structure from the extended position P2 into the storage position P1 by the above-mentioned operations being carried out in reverse order (d, c, b, a), each operation (rotation, translation) being carried out in the opposite direction.

Moreover, the segmented structure 1 may comprise means (not shown) for enabling a final positioning between a secondary panel 3, 4 and the main panel 2 in the situation shown in FIGS. 8 and 9, and means for locking the panels in the completely extended position of the segmented structure 1 from FIG. 9.

The invention claimed is:

1. A segmented structure, in particular for a satellite antenna reflector, said segmented structure comprising:

a main panel, having a main panel front face and a main panel rear face, and a secondary panel having a secondary panel front face and a secondary panel rear face; and at least one extension device connected to the main panel rear face and the secondary panel rear face, and being configured to bring said secondary panel into one or the other of the two following positions relative to said main panel:

a storage position in which said secondary panel is positioned at least in part above said main panel on the main panel rear face, the secondary panel front face being oriented in the same direction as the main panel front face; and an extended position, in which said secondary panel is positioned next to and against said main panel to form a continuous assembly at least on the front faces of said panels, said extension device comprising:

a translation system configured to translate said secondary panel relative to said main panel and connected to said secondary panel by an external end; and a rotation system connected to an internal end of said translation system, and to the main panel rear face, wherein:

said rotation system is configured to rotate said translation system and the secondary panel relative to said main panel; and said translation system comprising:

an assembly of two articulated arms, each of said articulated arms comprising an external segment pivotally connected to an internal segment, the external segment of each of said arms being pivotally connected to the secondary panel rear face; and an auxiliary rotation system connected to an internal end of each of the internal segments of the articulated arms and configured to cause a rotation in the region of each of said internal ends in a synchronized manner and in opposite directions to open out or fold away said assembly of articulated arms.

2. The segmented structure according to claim 1, wherein, for each of said articulated arms, the external connection of the external segment to the secondary panel rear face is equipped with a flexible joint.

3. The segmented structure according to claim 1, wherein said auxiliary rotation system comprises two motors, one of which is connected to the internal end of the internal segment of a first of said arms and is configured to rotate said internal segment, and the other of which is connected to the internal end of the internal segment of the second of said arms and is configured to rotate said internal segment, said motors being synchronized and controlled to bring about rotations in opposite directions.

4. The segmented structure according to claim 1, wherein said auxiliary rotation system comprises a single motor that is connected both to:

the internal end of the internal segment of a first of said arms by a first connection for transmitting rotations which is configured to rotate said internal segment; and the internal end of the internal segment of the second of said arms by a second connection for transmitting rotations which is configured to rotate said internal segment;

said first and second connections for transmitting rotations being driven by said single motor to transmit rotations in opposite directions at the same speed.

5. The segmented structure according to claim 4, wherein said motor is a gear motor reducer having two outputs opposite each other, each output being provided with a pulley configured to transmit a rotation.

6. The segmented structure according to claim 1, wherein said rotation system comprises two coaxial motors synchronised and controlled to bring about rotations in the same direction.

7. The segmented structure according to claim 1, wherein said rotation system comprises a transmission spindle that interconnects the internal ends of the two arms of the translation system, and a motor configured to rotate said transmission spindle.

8. The segmented structure according to 1 further comprising:

a central main panel;

two secondary panels arranged on either side of said central main panel when in the extended position in such a way as to be parabolic; and two extension devices connected to each of said secondary panels respectively.

9. A satellite antenna reflector comprising a segmented structure according to claim 1.

10. A satellite comprising at least one segmented structure according to claim 1.

11. A method for extending a segmented structure according to claim 1, wherein said method comprises, during the extension from the storage position into the extended position, the steps of:

a) performing a rotation from the storage position in a first rotation direction by means of said rotation system in such a way as to move said translation system, provided at the external end thereof with the secondary panel, away from the rear face of the main panel;

b) performing a translational movement in a first translation direction by means of said translation system in such a way as to bring said system into an opened out position;

c) performing a rotation in a direction counter to said first rotation direction by means of said rotation system in such a way as to bring the secondary panels and the main panel substantially into a common general plane; and d) performing a translational movement in a direction counter to said first translation direction by means of said translation system in such a way as to bring the secondary panel into contact with the main panel in a position that is the extended position.

12. The method according to claim 11, wherein the opened out position of the translation system corresponds to a maximum extension of said translation system.

13. The method according to claim 12, wherein, at step d), the auxiliary rotation system of the translation system performs a rotation in the same direction as in step b).

14. The method according to claim 11, wherein, at step d), the auxiliary rotation system of the translation system performs a rotation in the direction counter to that in step b).

* * * * *